US008089013B2

(12) United States Patent
Steckl et al.

(10) Patent No.: US 8,089,013 B2
(45) Date of Patent: Jan. 3, 2012

(54) LIQUID LOGIC STRUCTURES FOR ELECTRONIC DEVICE APPLICATIONS

(75) Inventors: Andrew J. Steckl, Cincinnati, OH (US); Jason C. Heikenfeld, New Richmond, OH (US)

(73) Assignee: University of Cincinnati, Cincinnati, OH (US)

( * ) Notice: Subject to any disclaimer, the term of this patent is extended or adjusted under 35 U.S.C. 154(b) by 1141 days.

(21) Appl. No.: 11/569,412

(22) PCT Filed: May 20, 2005

(86) PCT No.: PCT/US2005/017752

§ 371 (c)(1),
(2), (4) Date: Nov. 20, 2006

(87) PCT Pub. No.: WO2005/114740

PCT Pub. Date: Dec. 1, 2005

(65) Prior Publication Data

US 2007/0221484 A1 Sep. 27, 2007

Related U.S. Application Data

(60) Provisional application No. 60/573,662, filed on May 21, 2004.

(51) Int. Cl.
*H01H 29/00* (2006.01)

(52) U.S. Cl. ..... 200/182

(58) Field of Classification Search ..... 200/182
See application file for complete search history.

(56) References Cited

U.S. PATENT DOCUMENTS

| | | | | |
|---|---|---|---|---|
| 4,238,757 | A * | 12/1980 | Schenck | 257/253 |
| 5,543,024 | A * | 8/1996 | Hanazato et al. | 257/253 |
| 5,912,606 | A | 6/1999 | Nathanson et al. | |
| 6,565,727 | B1 | 5/2003 | Shenderov | |
| 6,603,444 | B1 | 8/2003 | Kawanami et al. | |
| 6,833,059 | B2 * | 12/2004 | Kawarada | 204/403.01 |
| 2003/0085850 | A1 | 5/2003 | Feenstra et al. | |
| 2003/0103021 | A1 | 6/2003 | Young et al. | |

(Continued)

FOREIGN PATENT DOCUMENTS

EP 1293807 A1 3/2003

OTHER PUBLICATIONS

Kim, Joonwon et al., "A Micromechanical Switch with Electrostatically Driven Liquid-Metal Droplet", The 11th International Conference on Solid-State Sensors and Actuators, Munich, Germany, Jun. 10-14, 2001 (4 pages).

(Continued)

*Primary Examiner* — Renee Luebke
*Assistant Examiner* — Lheiren Mae Caroc
(74) *Attorney, Agent, or Firm* — Wood, Herron & Evans, LLP

(57) ABSTRACT

Electronic devices (10, 30, 50) utilizing electrically-controlled liquid components to accomplish device switching. Electric fields are used in a device structure to manipulate the position and/or geometrical shape of a conductive fluid or liquid (60, 24) using electrowetting. This manipulation regulates the flow of current between electrodes of the device structure, such as the source and drain regions (16, 20) of a transistor construction, by bridging a non-conductive channel (15) separating the electrodes (16, 20) so that the electrodes (16, 20) are electrically coupled.

18 Claims, 4 Drawing Sheets

U.S. PATENT DOCUMENTS

| | | | | |
|---|---|---|---|---|
| 2005/0199959 | A1* | 9/2005 | Chiang et al. | 257/368 |
| 2005/0199960 | A1* | 9/2005 | Hoffman et al. | 257/368 |
| 2005/0199961 | A1* | 9/2005 | Hoffman et al. | 257/368 |

OTHER PUBLICATIONS

European Patent Office, Supplementary European Search Report issued in corresponding European Patent Application No. EP 05752270.8 dated May 3, 2007.

Saurei, Lisa et al., Design of an Autofocus Lens for VGA 1/4" CCD and CMOS Sensors, Proceedings of The International Society for Optical Engineering, vol. 5249, pp. 288-296 (2004).

Hayes, Robert A. et al., Video-speed Electronic Paper Based on Electrowetting, Nature, vol. 425, pp. 383-385 (2003).

Berge, B. et al., Variable Focal Lens Controlled by an External Voltage: an Application of Electrowetting, Eur. Phys. J. E, vol. 3, pp. 159-163 (2000).

Quilliet, Catherine et al., Electrowetting: a Recent Outbreak, Current Opinion in Colloid & Interface Science, vol. 6, pp. 34-39 (2001).

Beni, G. et al., Dynamics of Electrowetting Displays, J. Appl. Phys. vol. 52(10), pp. 6011-6015 (1981).

Pollack, Michael G. et al., Electrowetting-based Actuation of Liquid Droplets for Microfluidic Applications, Applied Physics Letters, vol. 77, No. 11, pp. 1725-1726 (2000).

Chiu, Daniel T., Using Three-dimensional Microfluidic Networks for Solving Computationally Hard Problems, Proc. Natl. Acad. Sci., vol. 98(6), pp. 2961-2966 (2001).

Heikenfeld, J. et al., Intense Switchable Fluorescence in Light Wave Coupled Electrowetting Devices, Applied Physics Letters, vol. 86, No. 1, 3 pages (2005).

* cited by examiner

LIQUID LOGIC STRUCTURES FOR ELECTRONIC DEVICE APPLICATIONS

CROSS-REFERENCE TO RELATED APPLICATIONS

This application claims the benefit of U.S. Provisional Application No. 60/573,662, filed on May 21, 2004, the disclosure of which is hereby incorporated by reference herein in its entirety.

FIELD OF THE INVENTION

The invention relates generally to semiconductor structures and devices and, more particularly, to structures, devices, and integrated circuits utilizing liquid logic and methods of fabricating such structures, devices, and integrated circuits.

BACKGROUND OF THE INVENTION

Semiconductor devices, such as field effect transistors (FET's), are familiar building blocks of integrated circuits formed in silicon substrates. A single silicon-based integrated circuit may feature many thousands to millions of FET's, along with other passive components such as resistors and capacitors. However, silicon based technologies face certain limitations. Limitations on silicon wafer size limit use in large area electronics. The high temperature processing required during silicon device processing prevents the use of low-cost substrates, such as plastics, and limits the application of advanced fabrication technologies, such as roll-to-roll processing. Silicon-based electronics are difficult to integrate seamlessly with chemical/biological components. A full extension to three-dimensional device structures is unlikely with silicon-based technologies. Silicon device structures are fundamentally planar and are therefore difficult, if not impossible, to adapt to non-planar surfaces.

Various nontraditional alternatives have been proposed to conventional silicon technologies. One alternative, quantum computing, has limited applications and has encountered manufacturing difficulties. Another alternative, DNA computing, is time consuming and suffers from imprecise operation. Yet another alternative, microfluidic computing, has found only limited applications. Still another alternative, organic electronics, offers limited performance, lifetime and reliability.

What is needed, therefore, is a switching scheme for device fabrication that does not suffer from the limitations of conventional silicon-based device technologies and the limitations of proposed alternatives to silicon-based device technologies.

SUMMARY OF THE INVENTION

The invention is directed to electronics based on electrically-controlled liquid components. More specifically, the invention is directed to the operation of individual electronic components (e.g., diodes, latches, transistors), wherein the active medium is composed of one or more liquids, to integrated electronic circuits incorporating components containing liquids and to systems that utilize such circuits.

In accordance with the principles of the invention, structures, devices and integrated circuits are provided with liquid logic. Liquid logic enables the fabrication of large area electronics (i.e., electronics on the human scale) such as flat panel displays, large array antennas, scanners/printers/copiers, large area sensors operating by chem/bio principles, thermal sensing, and radiation detection, full-size medical imaging systems, and photovoltaics. The liquid logic of the invention may be fabricated at room temperature, which permits the implementation of plastic substrates which are flexible and inexpensive and permits roll-to-roll processing. The liquid logic of the invention provides higher functionality by permitting the integration of various technologies/devices (i.e., hybrid electronics). The liquid logic of the invention increases packing density, which may permit fabrication of multi-layer or three-dimensional circuits of higher density than currently possible with conventional device technologies. The liquid logic of the invention is applicable to non-planar surfaces, unlike silicon-based technologies. For example, sensors may be formed using the liquid logic of the invention on curved surfaces of aircraft and spacecraft, soldiers, and other large-scale structures such as vehicles, power plants, bridges, etc. The liquid logic of the invention may also be applied to fabricate flexible electronics, such as electro-textiles (i.e., wearable electronics), electronic newspapers, and flexible large area displays and signs. The liquid logic devices of the invention utilize electric-field-controlled liquid components, which are distinguishable over devices in which liquid components are mechanically controlled, such as mercury switches.

The liquid logic devices of the invention are expected to exhibit superior electrical properties as compared with conventional alterative to silicon device technologies. Both n-channel and p-channel devices may be formed, which permits the creation of CMOS-like circuits that operate at low power. The carrier mobility is higher in the liquid logic devices of the invention than available in Organic FET's or amorphous silicon. The inventive liquid logic devices have a high current capability and are capable of bistable operation at low power. The inventive liquid logic devices are versatile in that CMOS-like transistors may be applied to many diverse applications. The inventive liquid logic devices may be formed by simple, room temperature fabrication techniques at a very low cost and using plastic substrates. The inventive liquid logic devices may be fabricated by non-lithographic wet/soft processing methods, such as ink jet printing, molding, and stamping, and may be formed by roll-to-roll fabrication techniques. The inventive liquid logic may be easily integrated with micro- and macro-fluidic applications.

The liquid logic and electrowetting switching of the invention may be applied to fabricate various device types, including but not limited to latches, transistors and inverters. Transistors may be formed with either upright or inverted component arrangements and as either p-channel or n-channel devices, which are easily and conveniently integrated on a single substrate.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION

In accordance with the various embodiments of the invention, electric fields are used in a device structure to manipulate the position and/or geometrical shape of one or more fluids or liquids using electrowetting for controlling the flow of current between electrodes of the device structure. Generally, one of the liquids is conductive and a second liquid, if present, is electrically insulating or also electrically conducting, certain surfaces of the device structure are either hydrophilic or hydrophobic, and the physical space occupied by one or more of the liquids can be manipulated by the application of an electric field. Electrowetting permits the fundamental switching process to be implemented using liquids. In terms of the external connections with the liquid-based device, voltages and currents very similar to conventional silicon-based CMOS devices are expected to be required, although the invention is not so limited.

Figure 1B:
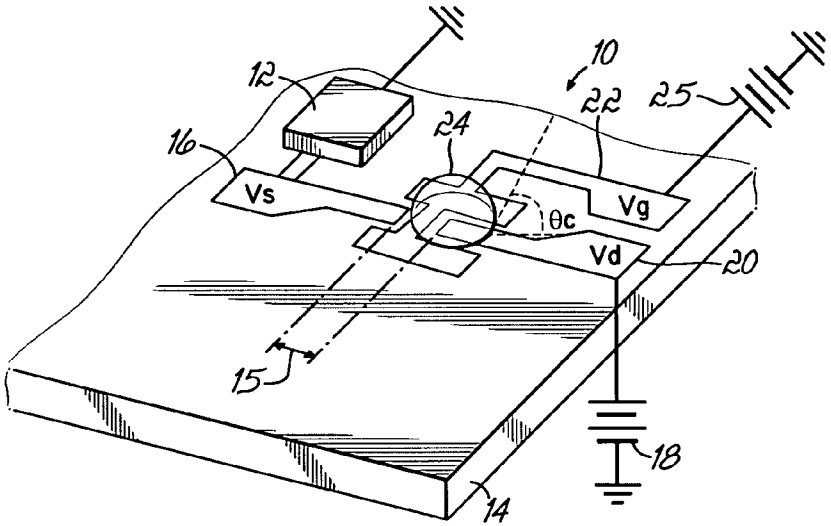
FIGS. 1A and 1B are diagrammatic views of a single latch transistor on a portion of a substrate that operates by changing the contact angle of a droplet of electrolyte liquid to electrically couple source and drain regions.
Figure 1A:
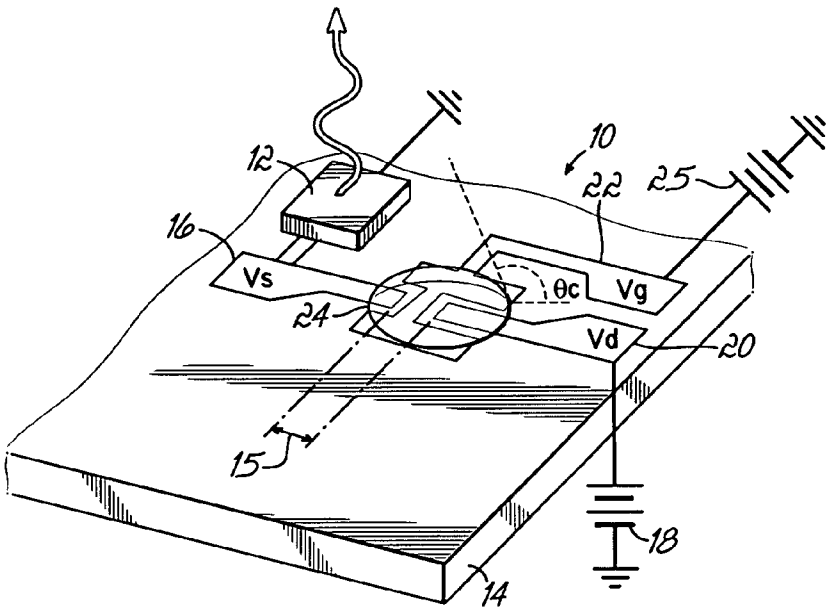

With reference to FIGS. 1A,B and 2A,B and in accordance with one embodiment of the present invention, a transistor having a single gate latch, generally indicated by reference numeral 10, is actuated using electrowetting-induced actuation for energizing or switching the operation of a functional device 12, such as a light-emitting diode (LED). The transistor 10 is fabricated on a substrate 14 and may be among multiple identical transistors 10 fabricated on substrate 14. The transistor 10 includes a source region 16, a drain region 20 spaced from the source region 16 by an electrically-insulating gap or non-conducting channel 15, a gate electrode 22, and an electrolyte droplet 24 positioned for selectively bridging the gap 15 to create current flow from the source region 16 to the drain region 20. The drain region 20 is coupled electrically with a power supply 18 and the gate electrode 22 is coupled electrically with a power supply 25. The electrolyte droplet 24 is constantly shorted to the drain region 20, which is held at a drain voltage of, for example, about five (5) volts. Therefore, the electric potential of the droplet 24 is approximately equal to the drain voltage of the drain region 20 regardless of whether the transistor 10 is in an on (i.e., conducting) state or an off (i.e., non-conducting) state.

Figure 2B:
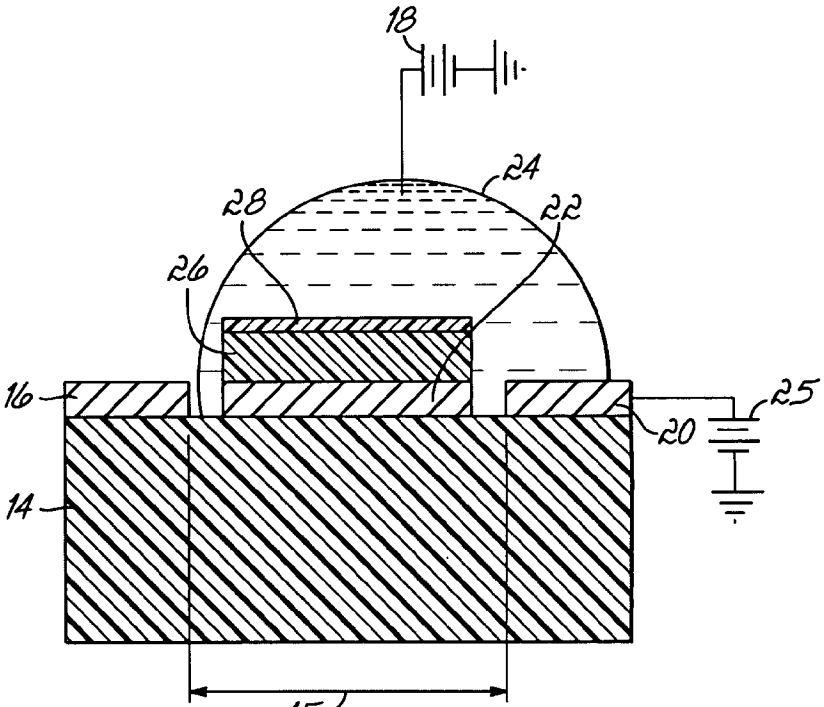
FIGS. 2A and 2B are diagrammatic cross-sectional views of the transistor of FIGS. 1A and 1B, respectively.
Figure 2A:
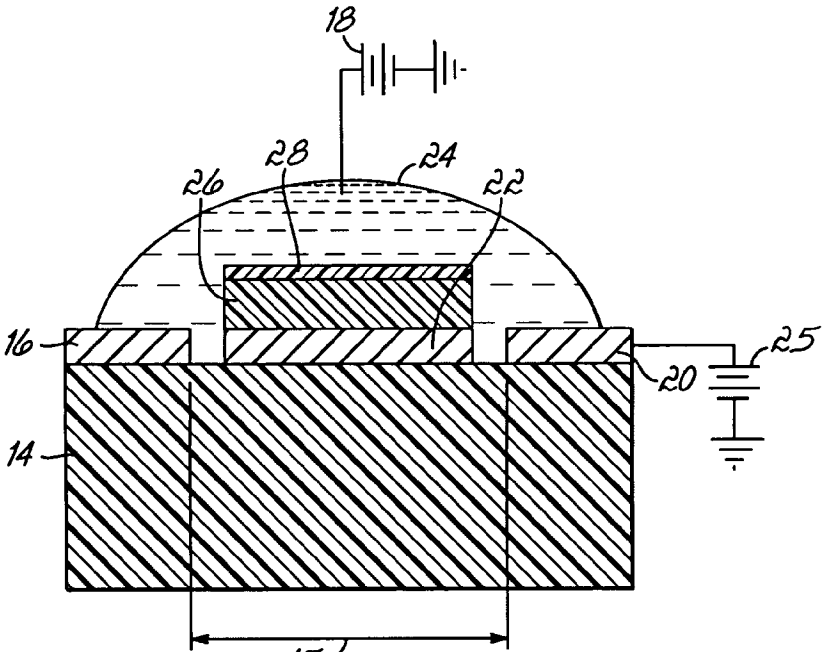

Although not shown in FIGS. 1A,B, all or a portion of the exposed surface of gate electrode 22, which is typically formed from a metal or other highly conductive material, is coated by a layer of an electrical insulator 26 (FIGS. 2A,B). The extent to which the electrical insulator 26 covers the gate electrode 22 is sufficient to electrically insulate the constituent conductive material from the electrolyte droplet 24 as the droplet 24 changes shape and/or position, as appropriate. The electrical insulator 26 covering the gate electrode 22 should be hydrophobic to furnish a relatively large liquid/solid contact angle. Optionally, a hydrophobic coating 28 (FIGS. 2A,B), such as DuPont TEFLON®, Asahi CYTOP®, or Cookson Parylene, may be applied to the surface of the electrical insulator 26 contacting the electrolyte droplet 24 in order to provide the necessary hydrophobicity.

The hydrophobicity of the surfaces of the source region 16 and drain region 20 wetted by the electrolyte droplet 24 permits the droplet 24 to freely make or release contact therewith, as regulated by voltage supplied from gate electrode 22. Exemplary hydrophobic materials include, but are not limited to, covalently bonded (i.e., non-polar) semiconductors such as Si, Ge, SiGe, and SiC. Conductive carbon films may also supply the desired hydrophobicity and electrical conductivity. Furthermore, the source and drain regions 16, 20 may be formed from a metal and coated at least across surface portions wetted by the droplet 24 with a very thin (about 10 mn or less) film of a hydrophobic fluoropolymer, such as TEFLON® commercially available from E. I. duPont deNemours and Company of Wilmington, Del. Fluoropolymer layers of this thickness are believed to exhibit adequate electrical conductivity due to electron tunneling to provide a current path to the underlying material of the source and drain regions 16, 20, while maintaining a high degree of hydrophobicity. In addition, thin or thick hydrophobic films may be used in conjunction with electrical conductor, semiconductor, or insulator films to create composite films that are hydrophobic and insulating, semiconducting, or electrically conducting.

The substrate 14 may be any material having a surface suitable for fabricating the source region 16, drain region 20 and gate electrode 22 and onto which the droplet 24 may be deposited. The characteristics of this surface of substrate 14 are also suitable to permit the droplet 24 to be moved and/or experience a change in contact angle upon the application of an electric field from gate electrode 22. Exemplary materials for substrate 14 include any flexible or rigid polymer recognized as suitable for use in the invention by a person of ordinary skill in the art. The substrate 14, or additional materials placed on the substrate 14, may be embossed, stamped, micro-replicated, or contain wells or channels or other non-planar features which assist in isolation, motion control, and containment, of various liquids of the present invention.

The material constituting the substrate 14 may have a high enough resistivity such that, if the source and drain regions 16, 20 are not bridged by droplet 24, there is no current path across the channel 15 through which significant electrical current could flow between the source and drain regions 16, 20. Accordingly, the channel 15 is non-conducting in this state.

The electrolyte constituting droplet 24 may be any suitable conductive fluid, including but not limited to an aqueous solution of an ionic compound, such as potassium chloride dissolved in water. The electrolyte may optionally include non-electrolytic liquids, like Acetonitrile. The droplet 24 may be formed from a liquid metal, such as mercury (Hg) or gallium (Ga) or a metal alloy like an indium/gallium (In/Ga) alloy. The droplet 24 may also be a liquid conducting molecule like methanol, an inorganic/organic mixture like polyethylenethioxythiophene (PEDOT) mixed with water, or a mixture of a dielectric fluid with a conducting fluid, such as a mixture of water with one of the Fluorinert™ electronic liquids commercially available from 3M Corporation of St. Paul, Minn. The electrolyte droplet 24 may consist of multiple individual sub-droplets of conducting fluids that collectively form droplet 24.

The electrolyte droplet 24 has a characteristic contact angle with the surface of substrate 14. The contact angle represents the angle formed as a result of contact between the droplet 24 and substrate 14, and reflects the interfacial affinity between the droplet 24 and substrate 14 (i.e., the wettability of the substrate with respect to the droplet). The contact angle is inversely related to interfacial affinity. For example, a highly hydrophilic substrate 14 forms a low contact angle with respect to droplet 24. Similarly, a highly hydrophobic substrate 14 forms a high contact angle with respect to droplet 24.

In use and with continued reference to FIGS. 1A,B and 2A,B, a voltage applied to the electrolyte droplet 24 causes droplet 24 to wet (i.e., contact angle decrease as shown in FIGS. 1A, 2A) the hydrophobic surface of the gate electrode 22 or de-wet (i.e., contact angle increase as shown in FIGS. 1B, 2B) the hydrophobic surface of the gate electrode 22. The transistor 10 is initially in the off state (FIG. 1B) in which non-conducting gap 15 electrically isolates the source and drain regions 16, 20 and the drain region 20 is biased at, for example, +5 volts. As shown in FIG. 1A, a gate voltage of, for example, negative five volts (−5 V) is applied from power supply 25 to the gate electrode 22. This causes a net voltage drop equal to the sum of the drain and gate voltages (i.e., 10 V in the exemplary embodiment) between the gate electrode 22 and the electrolyte droplet 24. Specifically, the voltage applied to the gate electrode 22 increases the area of the gate electrode 22 wetted by the electrolyte droplet 24. The electrostatic attraction between the droplet 24 and the gate electrode 22 is sufficient to effectively lower the interfacial surface tension (i.e., reduce the contact angle) between the droplet 24 (e.g., high surface tension) and the hydrophobic surface of electrical insulator 26 (e.g., low surface energy) on gate electrode 22.

As a result of the increased wetting of gate electrode 22, the electrolyte droplet 24, which is continuously shorted to the drain region 20, changes shape so as to contact the surface of source region 16 and, as a result, is then also shorted to the source region 16. The ensuing bridging of the non-conducting channel 15 between the source region 16 and drain region 20 by droplet 24 permits current to flow through the droplet 24 from source region 16 to the drain region 20, which places the transistor 10 in the on state. Portions of the droplet 24 thereby define a current path between the source and drain regions 16, 20. Current then flows from the drain region 20 to the functional device 12, which energizes device 12.

With reference to FIG. 1B, if the gate voltage on the gate electrode 22 is discontinued, the net voltage between the gate electrode 22 and the droplet 24 returns to the drain voltage (e.g., 5 volts) so that the transistor 10 returns to the off state. Similarly, if the gate electrode 22 is biased at ground potential or with a small positive voltage (e.g., 5 volts), the net voltage between the gate electrode 22 and the droplet 24 is reduced to a voltage less than the drain voltage, respectively, to return the transistor 10 to the off state. As a result, the droplet 24 de-wets the hydrophobic surface (i.e., the contact angle increases). Upon de-wetting, the electrolyte droplet 24 loses contact with the source region 16, which leaves the source region 16 in an electrically floating state. This, in turn, de-energizes the functional device 12 because the source region 16 and drain region 20 are again separated by the non-conducting channel 15. The channel 15 is non-conductive to the extent that any current transfer between the source region 16 and drain region 20 is insufficient to energize the functional device 12. As a result, the transistor 10 is returned to the off state.

Figure 3B:
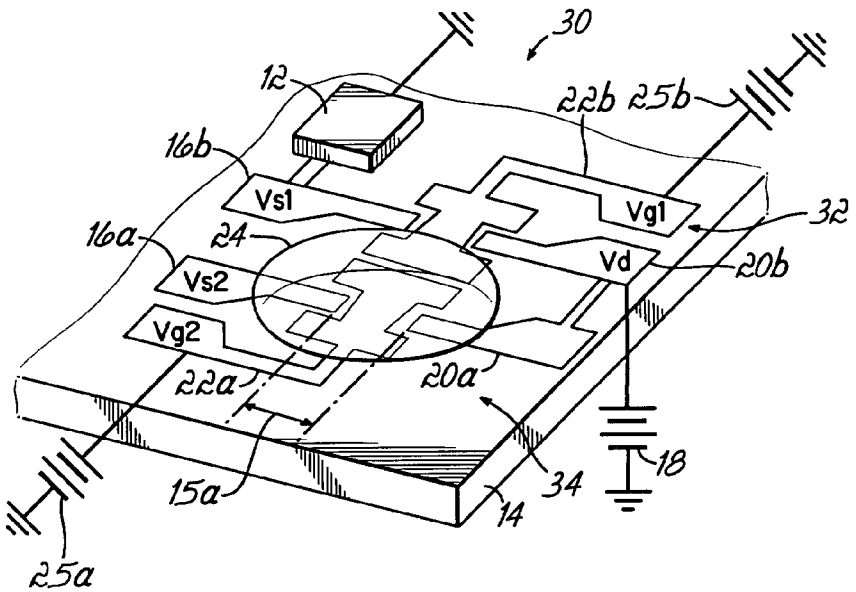
FIGS. 3A and 3B are diagrammatic views of a two gate latch on a portion of a substrate that operates by moving a droplet of electrolyte liquid across the surface of the substrate to electrically couple source and drain regions.
Figure 3A:
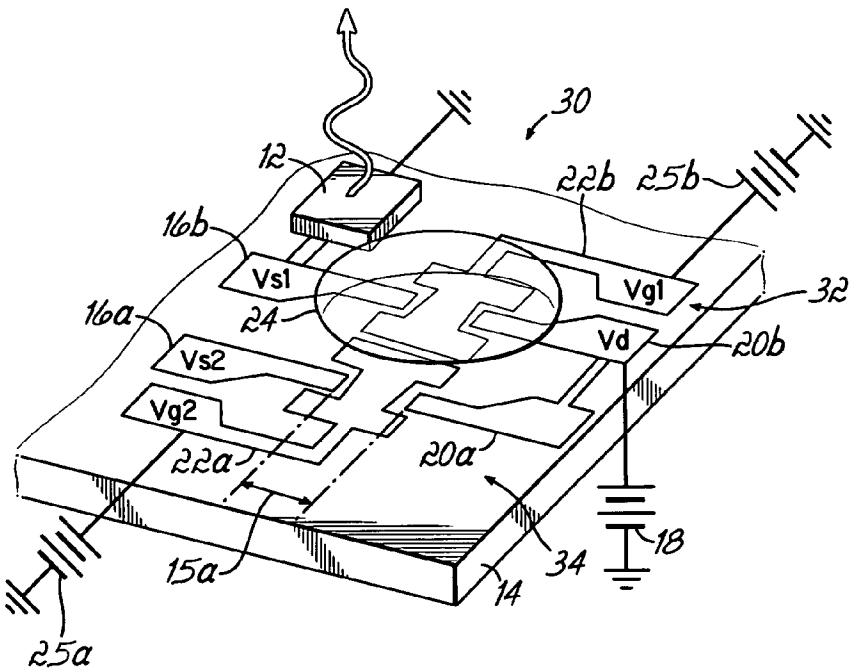

With reference to FIGS. 3A and 3B and in accordance with an alternative embodiment of the present invention, a moving droplet approach is shown for electrowetting a transistor, generally indicated by reference numeral 30. Transistor 30 includes a pair of latches 32, 34 each constructed similar to the transistor 10 (FIGS. 1A,B). Accordingly, the components of the latch 32 directly coupled with functional device 12 will be labeled with like reference numerals as transistor 10 and an appended "b", and the components of the latch 34 will be labeled with like reference numerals as transistor 10 and an appended "a".

With specific reference to FIG. 3A, transistor 30 is switched to the on state by biasing the gate electrode 22*b* of latch 34 (Vg1) at a gate voltage (e.g., −5 volts) with a power supply 25*b*. Because the droplet 24 is always shorted to the drain region 20*b* at a drain potential (e.g., +5 volts), this effectively provides a net voltage drop of ten (10) volts between gate electrode 22*b* and the droplet 24. This net voltage causes the droplet 24 to further wet the surface of the electrode 22*b* and causes the droplet 24 to be attracted toward electrode 22*b*. The translation or movement of the droplet 24 across the substrate shorts the drain region 20*b* to source region 16*b* (e.g., Vs1) to create a current path, including the droplet 24, that bridges the non-conducting gap 15*a* and ultimately powers the functional device 12. A portion of the droplet 24 is also in contact with gate electrode 22*a* of latch 32. However, gate electrode 22*a* is held at ground potential or a small positive voltage (e.g., 5 volts), or is left floating. Therefore, the net voltage drop between gate electrode 22*a* and the droplet 24 (e.g., 5 volts or less) alone is insufficient to cause the droplet 24 to wet gate electrode 22*a* or insufficient to attract the droplet 24 to gate electrode 22*a* .

With specific reference to FIG. 3B, gate electrode 22*b* of latch 34 is left either at ground potential, at a small positive voltage (e.g., 5 volts), or floating, and gate electrode 22*a* of latch 32 is biased at a negative potential (−5 volts) by power supply 25*a*. The net voltage drop between the droplet 24 and gate electrode 22*b* is inadequate for causing wetting of the droplet 24 to the hydrophobic surface overlying gate electrode 22*b*, which turns the transistor 30 to the off state. The net voltage between the droplet 24 and gate electrode 22*a* is equal to the gate voltage of gate electrode 22*a* and the drain voltage (e.g., 10 volts), causing the droplet 24 to wet the hydrophobic surface above gate electrode 22*a* and attract the droplet 24 towards gate electrode 22*a*. This causes the drain voltage to short from drain region 20*a* to source region 16*a*, and source region 16*b* remains floating, which de-energizes device 12. The preceding actuation is fully reversible and bi-stable. The process is bi-stable because the voltage application to the gate electrodes 22*a*, 22*b* is applied only for a duration sufficient to move the droplet 24 to the attracting one of the gate electrodes 22*a*, 22*b*. Because droplet motion may occur at approximately millisecond switching rates, a millisecond pulse applied to one of the gate electrodes 22*a*, 22*b* is sufficient to cause the transistor 30 to switch its state of operation.

Figure 4:
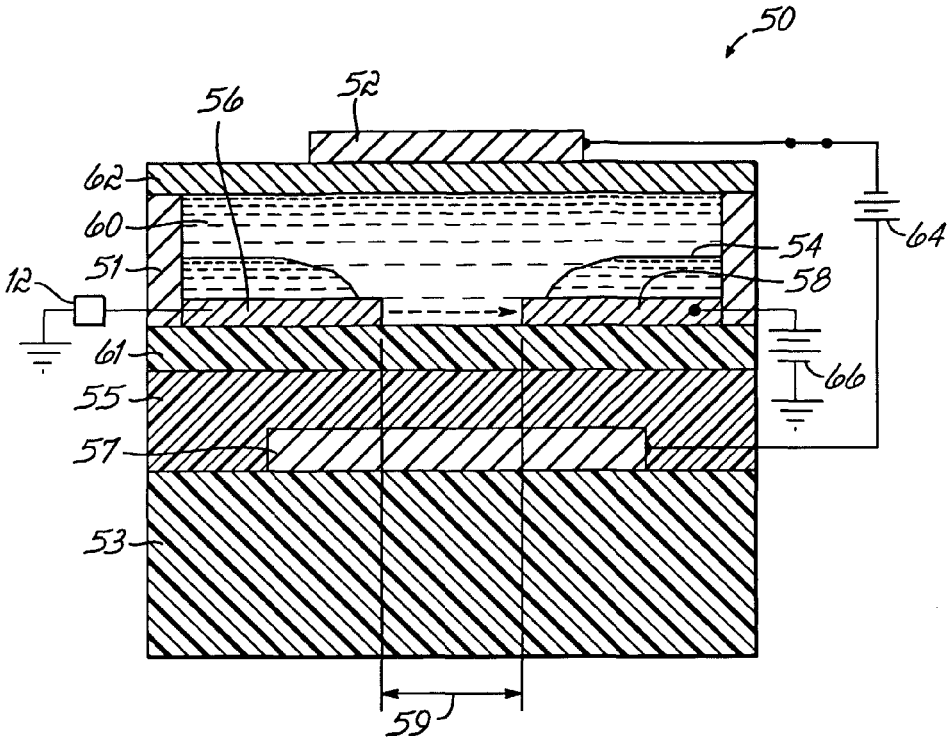
FIG. 4 is a diagrammatic cross-sectional view of a transistor, which operates using electro-wetting, switched to the on state.
Figure 5:
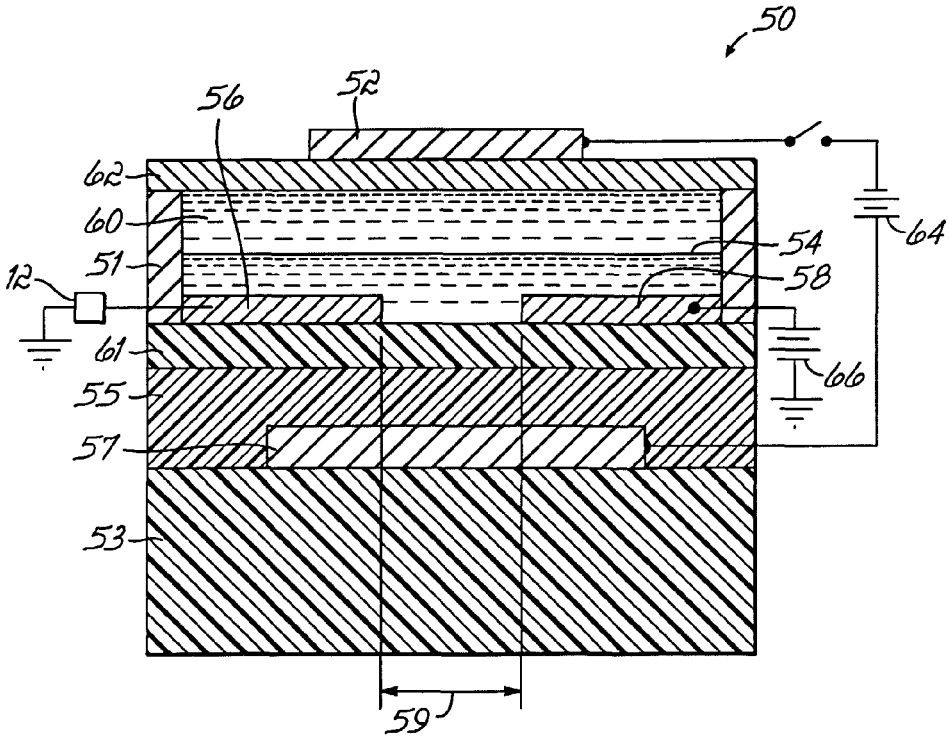
FIG. 5 is a diagrammatic cross-sectional view illustrating the transistor of FIG. 4 in the off state.

With reference to FIGS. 4 and 5 and in accordance with an alternate embodiment of the present invention, a liquid transistor 50 based on electrowetting is shown. With specific reference to FIG. 4, the transistor 50 includes a housing 51, a gate electrode 52 covering one open end of the housing 51, and a substrate 53 covering an opposite open end of the housing 51. These elements define a cell or compartment that encloses an amount of a non-conducting fluid, such as oil film 54, and an amount of an electrically conductive fluid or electrolyte 60 that is immiscible with the oil film 54. Carried by the substrate 53 inside the cell and wetted by the oil film 54 and electrolyte 60 to an extent contingent upon the state of the transistor 50 are source and drain regions in the form of source and drain electrodes 56, 58. Drain electrode 58 is biased at $V_s$ by a power supply 66. The gate electrode 52 is isolated electrically from the electrolyte 60 by an insulating barrier 62 and is electrically coupled with a power supply 64. A gap or channel 59 separates the source and drain electrodes 56, 58. The channel 59 is filled by a portion of the non-conductive oil film 54 when the transistor 50 is in the off state and is filled by a portion of the electrically conductive electrolyte 60 when the transistor 50 is in the on state.

The source and drain electrodes 56, 58 are hydrophobic or coated with an electrically conductive hydrophobic layer 64. The drain 58 is electrically coupled with the power supply 66. A portion of the substrate 53 operates as a second electrode 57 that is electrically isolated from the electrolyte 60 by an insulating layer 55, and the insulating layer 55 may be covered by an optional hydrophobic layer 61 if the insulating layer 55 is not sufficiently hydrophobic.

The surface tension (about 20-30 dynes/cm) of the oil film 54 is significantly lower than the surface tension (about 40-70 dynes/cm) of the electrolyte 60. This forces the oil to prefer to form a film 54 between the electrolyte 60 and the hydrophobic source and drain electrodes 56, 58 (about 15-20 dynes/cm). The oil film 54 (FIG. 5A) is continuous and unbroken so long as insufficient voltage is applied to the gate electrode 52. When a sufficient net voltage (e.g., 5 to 10 volts) is applied between the gate electrode 52 and source or drain electrodes 56, 58, the oil film 54 is displaced due to electrostatic attraction or repulsion of the electrolyte 60 to all electrodes 52, 56, 58. Displacing the oil film 54 turns the transistor 50 "on." The electrolyte 60 bridges the non-conducting channel 59 between the source and drain electrodes 56, 58 allowing current to pass from source electrode 56 to the drain electrode 58. With removal of sufficient gate voltage from gate electrode 52, the oil film 54 returns to its natural film geometry, and electrically insulates the source and drain electrodes 56, 58. This turns the transistor "off." The amount of oil displacement is generally proportional to the applied gate voltage. Therefore, an increasing or decreasing area of contact between the electrolyte 60 and the source/drain electrodes 56, 58 can be achieved. This increasing/decrease area with applied gate voltage therefore allows controllable analog modulation of current flow from source electrode 56 to drain electrode 58.

In use, the transistor 50 is initially in an off state as shown in FIG. 5, in which a portion of the oil film 54 occupies the channel 59 between source and drain electrodes 56, 58 so that gap 59 is non-conducting. A gate voltage is applied from power supply 64 to the gate electrode 52 of transistor 50. The resultant electrowetting displaces the electrically insulating oil film 54 to switch the transistor 50 to the on state. By displacing the oil film 54, the source and drain electrodes 56, 58 are brought into contact with the electrolyte 60, as shown in FIG. 4. This effectively shorts the source and drain electrodes 56, 58 together to permit current flow by carrier transfer by bridging the gap 59 between the source and drain electrodes 56, 58. In the absence of voltage applied to the gate electrode 52 (FIG. 5), the oil film 54 naturally covers, coats, and electrically insulates all hydrophobic surfaces wetted by the electrolyte 60.

The construction of the transistor 10 (FIGS. 1A,B), transistor 30 (FIGS. 2A,B), and transistor 50 (FIGS. 4, 5) may be altered consistent with the principles of the present invention. For example, in alternate embodiments of the present invention, the patterns of the electrodes, such as the source region 16, drain region 20 and gate electrode 22 of transistor 10, may be interdigitated or of non-rhombic geometries. In addition, any or all liquids, such as the oil film 54 and electrolyte 60 of transistor 50, and any or all electrodes may be sufficiently resistive or semiconducting such that a permanent or temporary voltage drop occurs in desired geometrical directions. Electrodes may be non-planar and placed within, on the sides, above, or around the liquids. Liquids may be non-circular. Hydrophobic or hydrophilic surfaces may also be non-continuous or non planar and placed in various geometrical arrangements around the liquids. Applied voltages may be static, pulsed, alternating, or other commonly utilized waveforms in analogue and digital electronics. Current flow may be direct current or alternating current, real current or displacement current. Applied voltages may be static with alternating or other commonly utilized waveforms superimposed on a static waveform. These various forms of advanced voltage and current waveforms may serve to improve device speed, reliability, power consumption, current capacity, lifetime, reversibility, manufacturing cost, hysteresis, or other device structure, functionality, and performance parameters.

Voltage-complimentary liquid transistors may be integrated to create liquid integrated circuits performing common Boolean functions such as AND, OR, and NOR, or forming inverters, buffers, or any circuit or collections of circuits. Single liquid transistors (three or more electrodes), or even simple liquid diodes (two electrodes), of the present invention may be utilized for computing, switching, amplifying, sensing, or other electronic, opto-electronic, biomedical, micromechanical, sensor, transmission, or receiving applications.

In accordance with an alternative embodiment of the invention, any of the transistor 10 (FIGS. 1A,B), transistor 30 (FIGS. 2A,B), and transistor 50 (FIGS. 4, 5) may be configured to operate as a sensor that responds to an external stimulus for bridging the non-conductive channel to electrically couple source and drain regions. The external stimulus may be selected from the group consisting of an optical force, a physical force, and an electromagnetic force. In these embodiments of the invention, a gate electrode, like gate electrode 22 (FIG. 1A), may be omitted from the device constructions and the amount of conductive fluid moves by either changing shape, translating, or both in response to the external stimulus to electrically couple the source and drain regions. The modifications required to adapt the transistors described hereinabove would be apparent to a person of ordinary skill in the art and require no additional elaboration. Other than reliance upon the external stimulus to actuate the sensor as opposed to a bias potential from a gate electrode, the sensor operates in a manner similar to the transistors described hereinabove.

The following example illustrates particular properties and advantages of some of the embodiments.

EXAMPLE

The prototype liquid logic device described in the example is most consistent with the device operation outlined in FIGS. 1A,B. A 3" Si wafer was coated with an electrically insulating and hydrophobic DuPont Teflon AF fluoropolymer coating. An electrically conductive droplet containing water and PEDOT/PSS aqueous conductive polymer was then placed on the wafer. A drain electrode was inserted into the droplet, and a source electrode was placed adjacent to the droplet. The source and drain electrodes were then attached to an external battery and a functional device (LED) circuit. A gate electrode was attached to the upper surface of the droplet and a variable voltage source attached to the droplet with reference to the wafer (which acted as ground).

Upon application of an appropriate gate voltage (10V to 40V) to the droplet, the droplet wetted the hydrophobic surface of the wafer. This decreased the contact angle of the droplet to the hydrophobic surface and caused the droplet to contact the source electrode. This further caused the drain and source electrodes to short together, which enabled current flow in the functional circuit and caused the LED to turn on. The measured current in the functional circuit in the off state was zero (0) mA, and in the on state was five (5) mA. The gate electrode passed no measurable DC current into the system because the gate electrode was electrically insulated from the wafer, which was held at ground. Removing the gate voltage had the effect of allowing the droplet to return to its original state (de-wet the hydrophobic surface) and remove itself from contact with the source electrode. This turned the system "off" and darkened the LED.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. Thus, the invention in its broader aspects is therefore not limited to the specific details, representative apparatus and method, and illustrative example shown and described. Accordingly, departures may be made from such details without departing from the spirit or scope of applicants' general inventive concept.

What is claimed is:

1. A liquid logic structure operated by an electric field, comprising:

a substrate;

a source region on the substrate;

a drain region on the substrate, the source region separated from the drain region by a non-conductive channel; and an amount of a conductive fluid on the substrate, the conductive fluid being moveable on the substrate relative to at least one of the drain region or the source region in response to the electric field to bridge the non-conductive channel for electrically coupling the source region with the drain region and thereby provide a current path between the source and drain regions, wherein the conductive fluid includes a contact angle that changes in response to the electric field to provide the movement.

2. The liquid logic structure of claim 1 wherein the conductive fluid wets a first area on the substrate when the electric field is absent and a second area on the substrate when the contact angle of the conductive fluid is changed in response to the electric field, the conductive fluid bridging the non-conductive channel when wetting the second area.

3. The liquid logic structure of claim 1 wherein the conductive fluid has a first position on the substrate when the electric field is absent and a second position on the substrate when the electric field is present, the conductive fluid bridging the non-conductive channel when the conductive fluid is in the second position.

4. The liquid logic structure of claim 1 further comprising:

a gate electrode adapted to supply the electric field when electrically powered.

5. The liquid logic structure of claim 1 further comprising:

a functional device electrically coupled with the source, the functional device being powered when the source region with the drain region are electrically coupled.

6. A liquid logic structure operated by an electric field, comprising:

a substrate;

a source region on the substrate;

a drain region on the substrate, the source region separated from the drain region by a non-conductive channel; and an amount of a conductive fluid on the substrate, the conductive fluid being moveable on the substrate relative to at least one of the drain region or the source region in response to the electric field to bridge the non-conductive channel for electrically coupling the source region with the drain region and thereby provide a current path between the source and drain regions, and an amount of a non-conductive fluid occupying the non-conductive channel, the conductive fluid displacing the non-conductive fluid in response to the electric field so that the conductive fluid bridges the non-conductive channel.

7. The liquid logic structure of claim 6 wherein the conductive fluid and the non-conductive fluid are confined inside a compartment that encloses the source region and the drain region.

8. The liquid logic structure of claim 6 further comprising:

a gate electrode adapted to supply the electric field when electrically powered.

9. The liquid logic structure of claim 6 further comprising:

a functional device electrically coupled with the source, the functional device being powered when the source region with the drain region are electrically coupled.

10. A liquid logic structure operated by application of an external stimulus, comprising:

a substrate;

a source region on the substrate;

a drain region on the substrate, the source region separated from the drain region by a non-conductive channel; and an amount of a conductive fluid on the substrate, the conductive fluid being moveable on the substrate relative to at least one of the drain region or the source region in response to the external stimulus for bridging the non-conductive channel to electrically couple the source region with the drain region and thereby provide a current path between the source and drain regions, wherein the external stimulus is selected from the group consisting of an optical force, a physical force, and an electromagnetic force.

11. The liquid logic structure of claim 10 further comprising:

a functional device electrically coupled with the source, the functional device being powered when the amount of conductive fluid bridges the non-conductive channel.

12. A method for switching a device structure having a source region and a drain region separated by a non-conductive channel, comprising:

applying an electric field effective to move an amount of a conductive fluid relative to at least one of the drain region or the source region to bridge the non-conductive channel and electrically couple the source and the drain and thereby provide a current path between the source and drain regions, wherein applying the electric field further comprises changing a contact angle of the conductive fluid in response to the application of the electric field to cause movement for bridging the non-conductive channel.

13. The method of claim 12 wherein applying the electric field further comprises:

translating the conductive fluid in response to the application of the electric field to cause movement for bridging the non-conductive channel.

14. The method of claim 12 further comprising:

powering a functional device electrically coupled with the source when the conductive fluid bridges the non-conductive channel.

15. A liquid logic structure operated by application of an external stimulus, comprising:

a substrate;

first and second electrodes on the substrate, the first and second electrodes separated by a non-conductive channel;

an amount of a conductive fluid on the substrate, the conductive fluid being moveable on the substrate relative to at least one of the first electrode or the second electrode in response to the external stimulus to bridge the non-conductive channel for electrically coupling the first and second electrodes and thereby provide a current path between the first and second electrodes; and an amount of a non-conductive fluid occupying the non-conductive channel, the conductive fluid displacing the non-conductive fluid in response to the external stimulus so that the conductive fluid bridges the non-conductive channel.

16. The liquid logic structure of claim 15 wherein the first and second electrodes further comprise source and drain regions of a transistor, and the liquid logic structure further comprises a gate electrode adapted to apply an electric field as the external stimulus to move the amount of the conductive fluid for bridging the non-conductive channel to electrically couple the first and second electrodes.

17. A method for switching a device structure having first and second electrodes separated by a non-conductive channel, comprising:

applying an external stimulus effective to move an amount of a conductive fluid relative to at least one of the first electrode or the second electrode to bridge the non-conductive channel and electrically couple the first and second electrodes to thereby provide a current path between the first and second electrodes, wherein applying the external stimulus further comprises changing a contact angle of the conductive fluid in response to the application of the external stimulus to cause movement for bridging the non-conductive channel.

18. The method of claim 17 wherein applying the external stimulus further comprises:

translating the conductive fluid in response to the application of the external stimulus to cause movement for bridging the non-conductive channel.

* * * * *